US008081179B2

(12) United States Patent
Ruckmongathan

(10) Patent No.: US 8,081,179 B2
(45) Date of Patent: Dec. 20, 2011

(54) METHOD TO DISPLAY GRAY SHADES IN RMS RESPONDING MATRIX DISPLAY

(75) Inventor: Temkar Narasingarao Ruckmongathan, Bangalore (IN)

(73) Assignee: Raman Research Institute, Karnataka, Bangalore (IN)

( * ) Notice: Subject to any disclaimer, the term of this patent is extended or adjusted under 35 U.S.C. 154(b) by 973 days.

(21) Appl. No.: 12/072,084

(22) Filed: Feb. 21, 2008

(65) Prior Publication Data

US 2009/0201241 A1 Aug. 13, 2009

(30) Foreign Application Priority Data

Feb. 7, 2008 (IN) ..... 00328/CHE/2008

(51) Int. Cl.
*G09G 3/36* (2006.01)

(52) U.S. Cl. ..... 345/210; 345/94

(58) Field of Classification Search ..... 345/94, 345/95, 210

See application file for complete search history.

(56) References Cited

U.S. PATENT DOCUMENTS

| | | | | |
|---|---|---|---|---|
| 5,233,447 | A * | 8/1993 | Kuribayashi et al. | 345/97 |
| 5,675,353 | A * | 10/1997 | Tanaka et al. | 345/96 |
| 5,861,869 | A * | 1/1999 | Scheffer et al. | 345/691 |
| 7,245,282 | B2 * | 7/2007 | Jones | 345/94 |
| 2006/0114209 | A1 * | 6/2006 | Kim et al. | 345/94 |
| 2007/0257946 | A1 * | 11/2007 | Miller et al. | 345/694 |

OTHER PUBLICATIONS

Conner, A.R.; Scheffer, T.J., "Pulse-Height Modulation (PHM) Gray Shading Methods for Passive Matrix LCDs", In Focus Systems, Inc., Tualatin, OR, USA, Japan Display 92 (1992), pp. 69-72.

Kawakami, Hideaki; Hanmura, Hisao; Kaneko, Eiji, "Brightness Uniformity in Liquid Crystal Displays", Hitachi Research Laboratory, Ibaraki, Japan, SID 80 Digest (1980), pp. 28-29.

Panikumar, K.G.; Ruckmongathan, T.N., "Displaying Gray Shades in Passive Matrix LCDs Using Successive Approximation", Raman Research Institute, Bangalore, India, Proceedings of the 7th Asian Symposium on Information Display (ASID 2002), 5 pp.

Ruckmongathan, T.N., "A Successive Approximation Technique for Displaying Gray Shades in Liquid Crystal Dislays (LCDs)", IEEE Transactions on Image Processing, vol. 16, No. 2, Feb. 2007, pp. 554-561.

Ruckmongathan, T.N., "Addressing Techniques for RMS Responding LCDs—A Review", Asahi Glass Co. Ltd., Yokohama, Kanagawa, Japan, Japan Display 92 (1992), pp. 77-80.

Ruckmongathan, T.N., "Techniques for Reducing the Hardware Complexity and the Power Consumption of Drive Electronics", Raman Research Institute, Bangalore, Kamataka, India, 560080, Proc. of ASID 2006, Oct. 8-12, New Delhi, pp. 115-120.

Ruckmongathan, T.N.; Arun, V.; Kumar, Babu Hemanth, "Line-by-Line Addressing of RMS Responding Matrix Displays With Wavelets", Journal of Display Technology (2007 IEEE), pp. 1-8.

(Continued)

*Primary Examiner* — Chanh Nguyen
*Assistant Examiner* — Allison Walthall
(74) *Attorney, Agent, or Firm* — Harness, Dickey & Pierce, PLC

(57) ABSTRACT

A method to display gray shades in RMS responding display matrix, includes: selecting each row of the display matrix with a set of "s" discrete select voltages in a sequence or random and applying a set of discrete data voltages to a column of the display matrix wherein the data voltages are of both polarities and energy of the select and data waveforms that are applied to rows and columns are constants during the "s" time intervals for all the rows and columns to display gray shades in RMS responding display matrix.

15 Claims, 11 Drawing Sheets

OTHER PUBLICATIONS

Ruckmongathan, T.N.; Govind, M.; Deepak, G., "Reducing Power Consumption in Liquid-Crystal Displays", IEEE Transactions on Electron Devices, vol. 53, No. 7, Jul. 2006, pp. 1559-1566.

Ruckmongathan, T.N.; Manasa, U.; Nethravathi, R.; Shashidhara, A.R., "Integer Wavelets for Displaying Gray Shades in RMS Responding Displays", Journal of Display Technology, vol. 2, No. 3, Sep. 2006, pp. 292-299.

Ruckmongathan, T.N.; Nadig, Deepa S.; Ranjitha, P.R., "Gray Shades in RMS Responding Displays With Wavelets Based on the Slant Transform", IEEE Transactions on Electron Devices, vol. 54, No. 4, Apr. 2007, pp. 663-670.

Ruckmongathan, T.N.; Rao P, Nanditha; Prasad, Ankita, "Wavelets for Displaying Gray Shades in LCDs", Raman Research Institute, Bangalore, Karnataka, 560080 India, SID 05 Digest (2005), pp. 168-171.

Shashidhara, Amachavadi R.; Ruckmongathan, Temkar N., "Design and Implementation of a Wavelet-Based Addressing Technique (WAT)", Journal of the SID 15/3 (2007), pp. 213-223.

Suzuki, Yoshio; Sekiya, Mitsunobu; Arai, Kunihiko; Ohkoshi, Akio, "A Liquid-Crystal Image Display", Sony Corp., Tokyo, Japan, SID 83 Digest (1983), pp. 32-33.

H. Kawakami, et al., "Matrix Addressing Technology of Twisted Nematic Liquid Crystal Display", SID-IEEE Record of Biennial Display Conference, pp. 50-52, 1976.

* cited by examiner

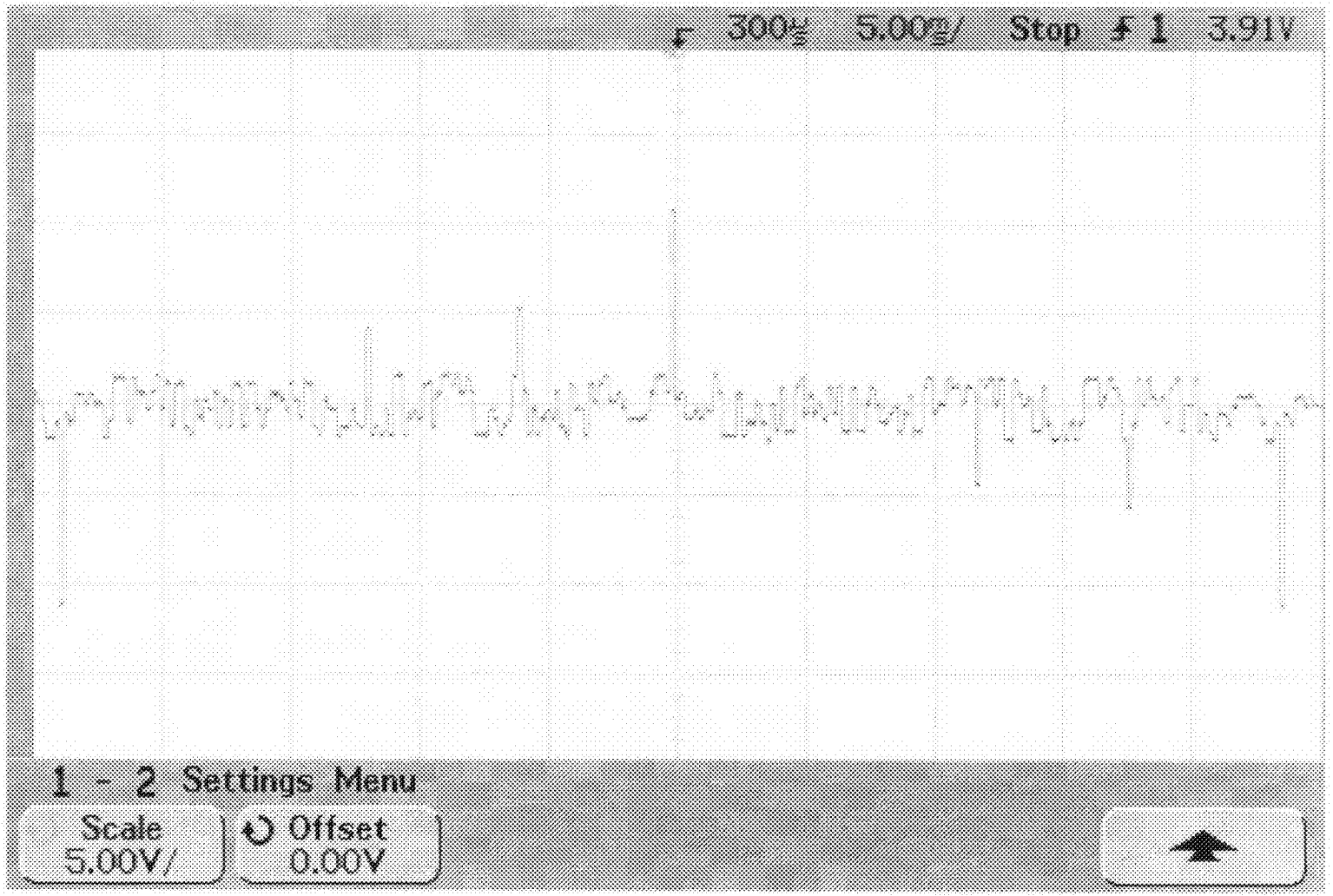
Figure 8 [contd.]

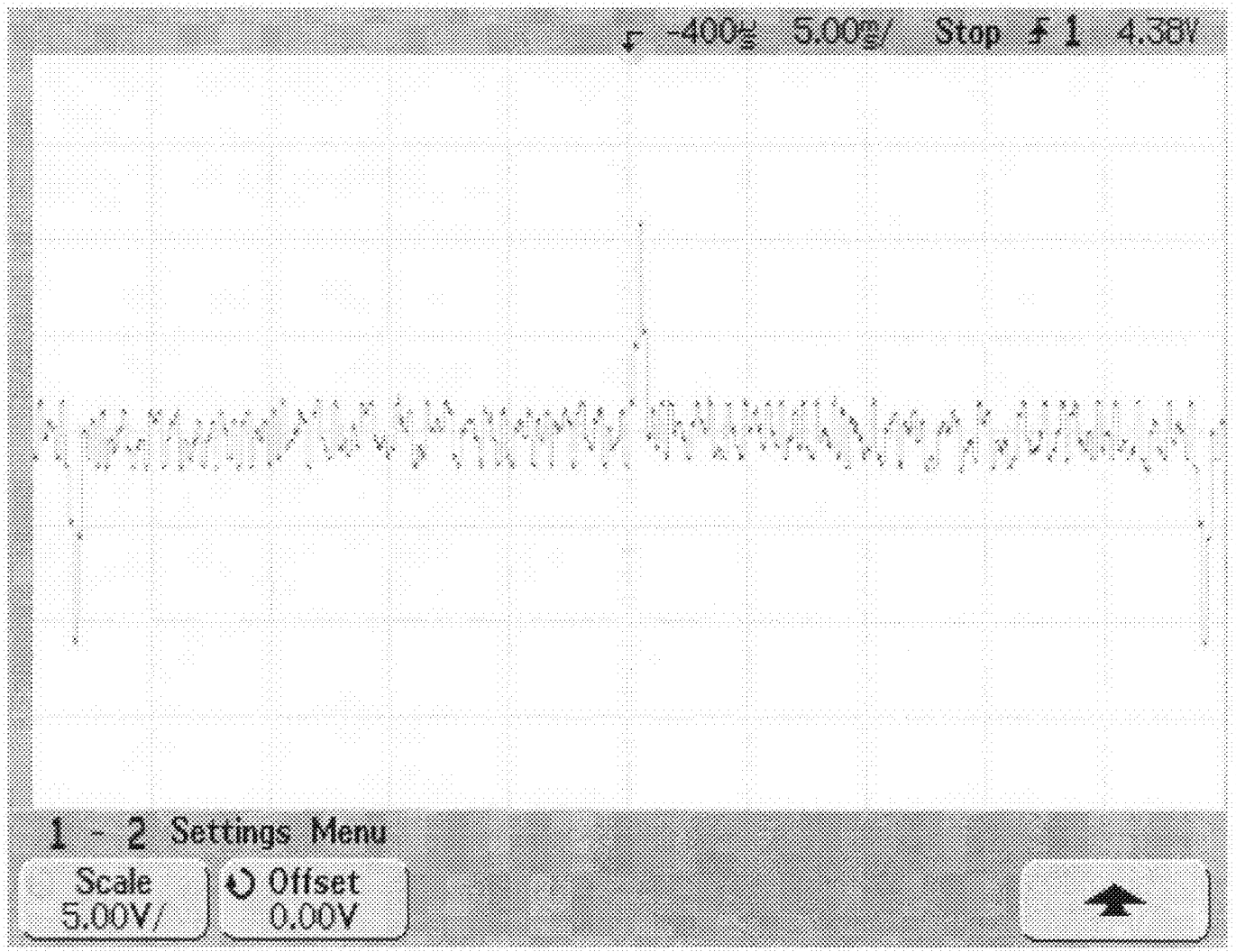
Figure 9 [contd.]

METHOD TO DISPLAY GRAY SHADES IN RMS RESPONDING MATRIX DISPLAY

This application claims benefit of Indian Patent Application No. 328/CHE/2008 filed Feb. 7, 2008 and the text of application 328/CHE/2008 is incorporated by reference in its entirety herewith.

FIELD OF THE INVENTION

Instant invention is related to a method to display gray shades in any RMS responding displays and more specifically passive matrix liquid crystal displays such as twisted nematic (TN) and super twisted nematic (STN) displays is disclosed. This method reduces the number of time intervals to complete a cycle and achieve more number of gray shades with simple waveforms having less number of voltages as compared to that of pulse-height modulation, amplitude modulation, successive approximation and wavelets based techniques.

BACKGROUND OF THE INVENTION

Quality of image improves with the number of gray shades pulse width modulation [1] and frame modulation [2] add gray shade capability to liquid crystal displays. The number of gray shades that can be displayed with these techniques is limited because the number of time intervals in a cycle increases linearly with the number of gray shades. In a matrix display with N address lines, N.(G−1) time intervals are necessary to display G gray shades. Flicker will be observed in the display if a large number of gray shades are displayed using frame modulation. The smallest time interval in pulse width modulation may be comparable or even less than the RC time constant (product of output resistance of drivers and equivalent capacitance of pixels) when the number of gray shades is large. Error in the RMS voltage across pixels due to distortion in the addressing waveforms will result in poor brightness uniformity among pixels that are driven to the same state in pulse width modulation when the number of gray shades is large. Another important consideration is the error in the RMS voltage across pixels as described next. The difference of RMS voltages across ON and OFF pixels is small in passive matrix displays. For example, the ON pixels get a voltage that is about 10% higher than that of OFF pixels in a matrix display with 100 address lines. The difference in RMS voltage across pixels that are driven to any two adjacent gray shades is even smaller and it decreases with increase in number of gray shades. The difference in RMS voltages of neighboring gray shades is about 0.625% for 16 gray shades, 0.156% for 64 gray shades and about 0.039% for 256 gray shades in a display where in 100 address lines are multiplexed. It is obvious that the error in the RMS voltage across the pixels has to be small as the number of grayscales is increased to ensure good brightness uniformity among pixels that are driven to the same gray shade. Error in the RMS voltages is primarily due to the following reasons:

a) Addressing waveforms consist of select or data voltages and any error in these voltages will contribute to the error in the RMS voltage across pixels.

b) Addressing waveforms have many abrupt (step like) transitions and the distortion in these steps due to RC time constant of the driver circuit will also contribute to error in RMS voltage across pixels.

While the error in voltages of the addressing waveforms can be almost eliminated with a well-designed voltage level generator (VLG), the distortions in the addressing waveforms cannot be eliminated but can be minimized as described in the following text.

a) Reduce the RC time constant of the drive circuit by reducing R and/or b) Increase the duration of the select time so that it is much larger than the RC time constant.

Output resistance of the driver circuit can be decreased either by buffering each output of the driver integrated circuit or by reducing the ON resistance of the analog switches in the multiplexers that select the voltages of the addressing waveforms. Both will increase the die size of the driver integrated circuit. It is expensive to decrease the output resistance or the ON resistance because of the large number of stages in the driver integrated circuit (A matrix display with N rows and M columns needs (N+M) drivers). It is preferable to reduce the number of intervals in a cycle to reduce the error due to distortion in the addressing waveforms so that the select time will increase (for a given refresh rate) and therefore RC time constant will be small as compared to the duration of the select time and thereby reduce the error in the RMS voltage. Amplitude modulation [3] and pulse height modulation [4] can display a large number of gray shades with a minimum number of time intervals. However, the number of voltages in the data waveforms is large. For example, the amplitude modulation that is based on line-by-line addressing has the least number of voltages in the addressing waveforms (i.e.2 (G−1)to display G gray shades) among these techniques. It is much higher for the pulse height modulation that is based on multi-line addressing. Either the hardware complexity of the drivers is high as in case of digital type drivers with analog multiplexers and digital to analog converters or the power consumption is high as in case of analog type data drivers when amplitude modulation and pulse height modulation are used for displaying gray shades. Successive approximation [5]-[6] technique can be used to display a large number of gray shades with simple drivers. The number of time intervals is equal to the smallest integer value that is equal to or greater than logarithm of the number of gray shades i.e. $\log_2 G$. Similarly wavelet based addressing techniques can display large number of gray shades. Number of time intervals necessary is about the same order for the wavelets based techniques for displaying gray shades [7]-[12]. Both the techniques have less number of voltages in the addressing waveforms as compared to amplitude and pulse height modulation techniques and therefore the hardware complexity of the drivers is also less as compared to amplitude and pulse height modulation. It is preferable to meet the following conditions when gray shades are displayed in passive matrix liquid crystal displays:

a. Number of time intervals in a cycle is small so that a large number of gray shades can be displayed without flicker and achieve good brightness uniformity among pixels that are driven to the same gray shade.

b. As few voltages as possible in the addressing waveforms so that the hardware complexity and the cost of driver circuit will be low.

The successive approximation technique and the wavelets based addressing techniques meet this criterion to some extent. FIG. 1 shows the typical waveforms of successive approximation technique and FIG. 2 shows the typical waveform of wavelets based technique for displaying gray shades in liquid crystal display. The number of voltages in the scanning and data waveforms is also less for these techniques and therefore the hardware complexity of the drivers is also less as compared to that of amplitude modulation and pulse height modulation techniques. The main objective of this invention is to reduce the number of time intervals to complete a cycle and achieve more number of gray shades with simple waveforms having less number of voltages as compared to that of sussessive approximation and wavelets based techniques.

REFERENCES

H. Kawakami, H. Hanmura and E. Kaneko, "Brightness uniformity in liquid crystal displays," *SID Intl Symp Digest Tech Papers*, pp. 28-29, (1980).

Y. Suzuki, M. Sekiya, K. Arai and A. Ohkoshi, "A liquid-crystal image display," *SID Intl Symp Digest Tech Papers*, pp. 32-33, (1983).

T. N. Ruckmongathan, *Addressing techniques for RMS responding LCDs—A review*, Proc. Japan Display '92, pp 77-80, 1992.

A. R. Conner and T. J. Scheffer, "Pulse-height modulation (PHM) gray shading methods for passive matrix LCDs," Proc. of Japan Display '92, pp. 69-72, (1992).

T. N. Ruckmongathan, *A Successive Approximation Technique for Displaying Gray Shades in Liquid Crystal Displays (LCDs)*, IEEE transactions on Image Processing, Vol. 16, No. 2, pp 554-561, February 2007.

K. G. PaniKumar and T. N. Ruckmongathan, *Displaying Gray Shades in Passive Matrix LCDs using Successive Approximation*, Proceedings of the 7th Asian Symposium on Information Display (ASID2002), Sep. 2-4, 2002, pp 229-232.

T. N. Ruckmongathan, Nanditha Rao P and Ankita Prasad, *Wavelets for Displaying Gray Shades in LCDs*, SID Int. Symp. Digest of technical papers, pp 168-171, 2005.

T. N. Ruckmongathan, U. Manasa, R. Nethravathi and A. R. Shashidhara, *Integer Wavelets for Displaying Gray Shades in RMS Responding Displays*, IEEE/OSA Journal of Display Technology, Vol. 2, No. 3, pp 292-299, September 2006.

A. R. Shashidhara and T. N. Ruckmongathan, *Design and Implementation of the Wavelet based Addressing Technique (WAT)*, Journal of the Society for Information Display, Vol. 15, No. 3, pp 213-223, 2007.

T. N. Ruckmongathan, Deepa S Nadig and P. R. Ranjitha, *Gray Shades in RMS Responding Displays With Wavelets Based on the Slant Transform*, IEEE transactions on Electron Devices, Vol. 54, No. 4, pp 663-670, April 2007.

T. N. Ruckmongathan, *Techniques for Reducing the Hardware Complexity and the Power Consumption of Drive Electronics*, Proceedings of the Asian Symposium on Information Display (ASID '06), Oct. 8-12, 2006, pp 115-120.

T. N. Ruckmongathan, V. Arun, and A. B. H Kumar, "Wavelets-based line-by-line addressing for displaying gray shades" IEEE/OSA J Display Technology Vol. 3. No. 4, pp 413-420, December 2007.

H. Kawakami H Y Nagae and E Kaneko, "Matrix Addressing Technology of Twisted Nematic Liquid Crystal Display," SID-IEEE Record of Biennial Display Conference pp 50-52, 1976.

T. N. Ruckmongathan, M. Govind and G. Deepak, *Reducing Power Consumption in Liquid-Crystal Displays*, IEEE transactions on Electron Devices, Vol. 53, No. 7, pp 1559-1566, July 2006.

SUMMARY OF THE INVENTION

Accordingly the invention provides for a method to display gray shades in RMS responding matrix display, comprising acts of: selecting each row of the display matrix with a set of 's' discrete select voltages in a sequential or random manner and applying a set of discrete data voltages to all the columns of the display matrix wherein the data voltages are of same or opposite polarity to that of select voltages with data voltage of each magnitude occurring a predetermined number of times in the 's' time durations.

OBJECTS OF THE INVENTION

Figure 1:
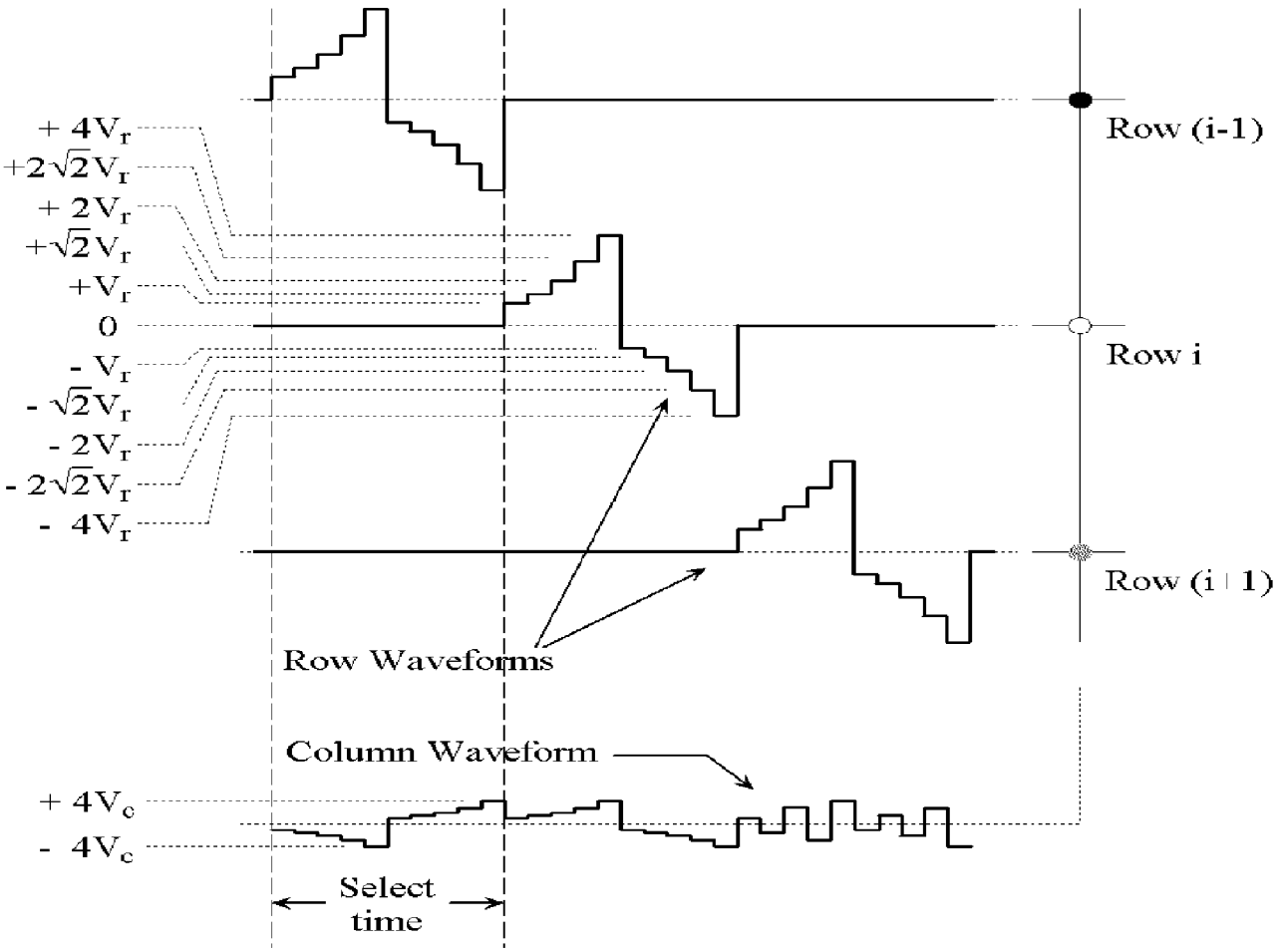
PRIOR ART Figure 1
FIG. 1: Shows typical waveforms of successive approximation technique where in $2^s$ gray shades can be displayed using s-time intervals (ref: 5). Row waveforms have 15 voltages; column waveforms have 14 voltages to display 128 gray shades with 7N time intervals. However drivers that are capable of applying just two voltages are adequate along with one 14:1 analog multiplexer each to select the appropriate voltage at a given instant of time and it is common to all stages of the driver circuit.
Figure 2:
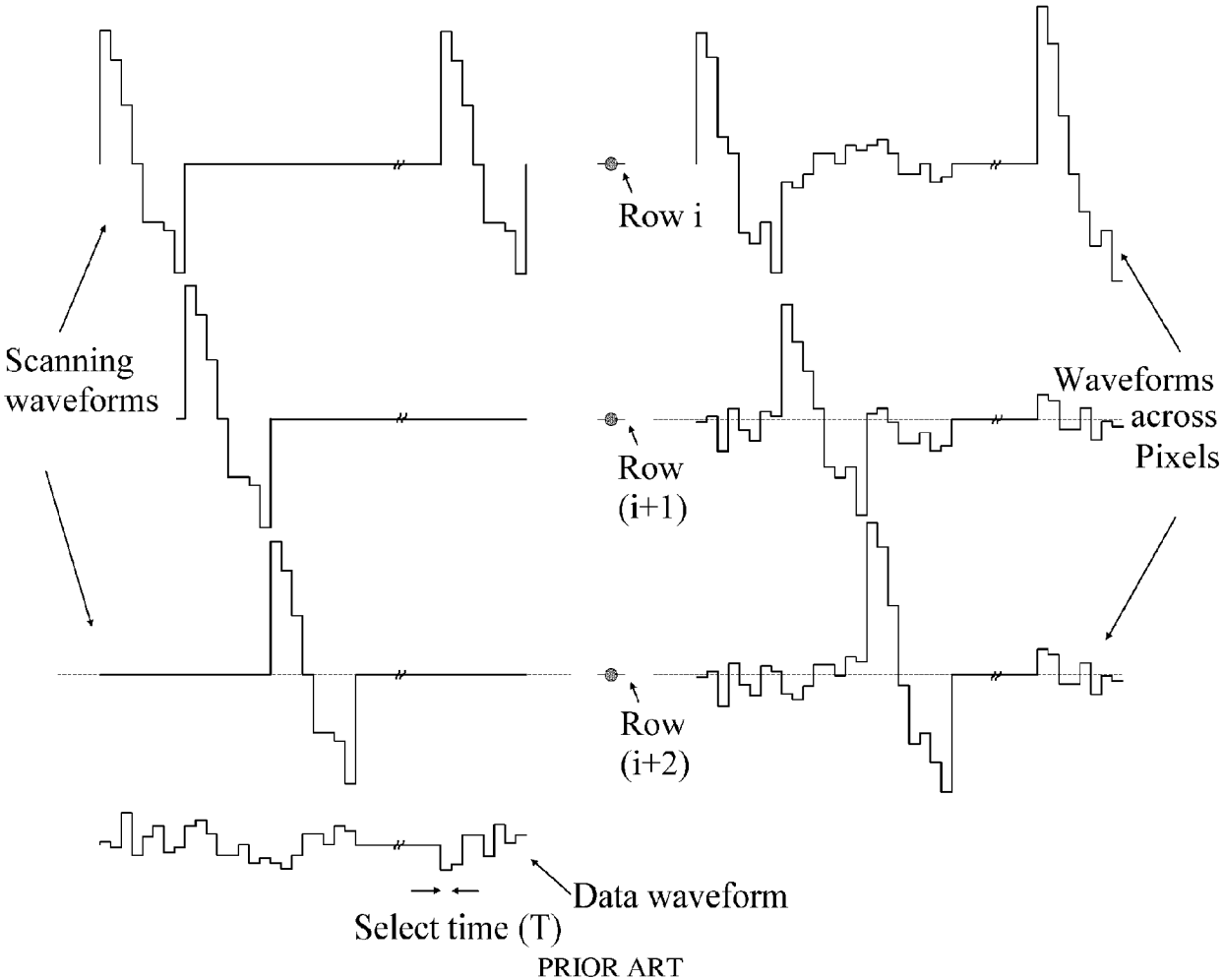
PRIOR ART Figure 2
FIG. 2: Shows typical addressing waveforms of wavelets based line-by-line addressing technique. Drivers that are capable of applying one out of eight voltages can be used as row drivers and column drivers to display 128 gray shades in 8N time intervals.

The main objective of the invention is to achieve a large number of gray shades with simple waveforms having less number of voltages and a small number of time intervals in a cycle.

Another main object of the present invention is to develop a method to display gray shades in RMS responding display matrix.

Another main object of this method is to improve brightness uniformity among pixels that are driven to the same state.

Another main object of this invention is to reduce the hardware of the driver circuit by having just a few voltages in the addressing waveforms.

Another main objective of this invention is to increase duration of application of each select voltage without causing flicker in the display.

Another main objective of this invention is to ensure that the energy delivered to the pixels in a row during the select and non-select duration of a cycle is substantially same as that of energy delivered to pixels each column during a cycle within practical limits for all the pixels in all the rows of the matrix display.

Another main objective of this invention is to ensure that the energy delivered to the pixel during 's' time intervals of data sequence is substantially same for all the gray shades in all the pixels in all the columns of the display.

Still another object of the present invention is to select a row of the display matrix with a set of discrete select voltages.

Yet another main object of the present invention is to apply a set of discrete data voltages to columns of the display matrix wherein the data voltages are of either polarity (i.e., same or opposite polarity to that of the select voltage)and the number of occurrence of each magnitude (in the data voltage sequence of length-s) is same for all data voltage sequences set to display gray shade in a RMS responding display matrix.

However the invention should not be considered to be restricting the scope of the method to the above-mentioned objectives. It is possible that this invention can meet other objectives as well that falls within the scope of this disclosure.

DETAILED DESCRIPTION

The primary embodiment of invention is a method to display gray shades in RMS responding display matrix comprising acts of:

a) selecting each row of the display matrix with a set of discrete select voltages one row after another in a sequential manner, and b) applying a set of discrete data voltages to a columns of the display matrix wherein the data voltages are of same or opposite polarity to that of select voltages with data voltage of each magnitude occurring a predetermined number of times in the s-time intervals to display gray shade in a RMS responding display matrix.

In yet another embodiment of the present invention the polarity of the select and the data voltages are changed periodically to achieve dc-free operation.

In still another embodiment of the present method each data voltage of specified amplitude has a select voltage that is $\sqrt{N}$ times the amplitude (magnitude) of the data voltage to achieve the maximum difference in RMS voltages of pixels that are driven to the two extreme gray shades i.e. ON and OFF states.

In still another embodiment of the present invention the amplitude of select voltages are suitable chosen to provide uniformly spaced RMS voltages from RMS voltage of OFF pixels to the RMS voltage of the ON pixels.

In still another embodiment of the present invention the select and data voltages are suitably chosen to provide for maximum number of RMS voltages for a given set of select and data voltages.

In still another embodiment of the present invention the select voltages in the s-time intervals are arranged to form a ascend voltage profile followed by a descending voltage profile to reduce power dissipation in driver circuit.

In still another embodiment of the present invention the select voltages are applied for equal durations.

In still another embodiment of the present invention the duration is longer than RC time constant of the driver circuit.

In still another embodiment of the present invention wherein varying amplitude and/or sign of the select and the data voltages to control the energy of the select and data waveforms during a cycle and there by vary RMS voltage across each pixel of the display.

In still another embodiment of the invention a subset of all the possible data voltage sequences is applied to develop RMS voltages that are useful to correct the non-linearity of electro-optic response and/or human eye response.

In still another embodiment of the present invention the number of gray shades is greater than that of successive approximation technique with same number of time intervals in a cycle for a given matrix display.

Still another embodiment of the invention is to achieve the maximum selection ratio and display more number of gray shades in the display than possible with successive approximation technique with same number of time intervals in a cycle for a given matrix display.

In still another embodiment of the present invention the display is passive matrix liquid crystal display.

In still another embodiment of the present invention the row of the display matrix is can be randomly selected with the sequence of 's' select voltages by ensuring that each row is selected just once in a cycle instead of the sequential selection of rows in the conventional methods of matrix addressing.

Figure 3:
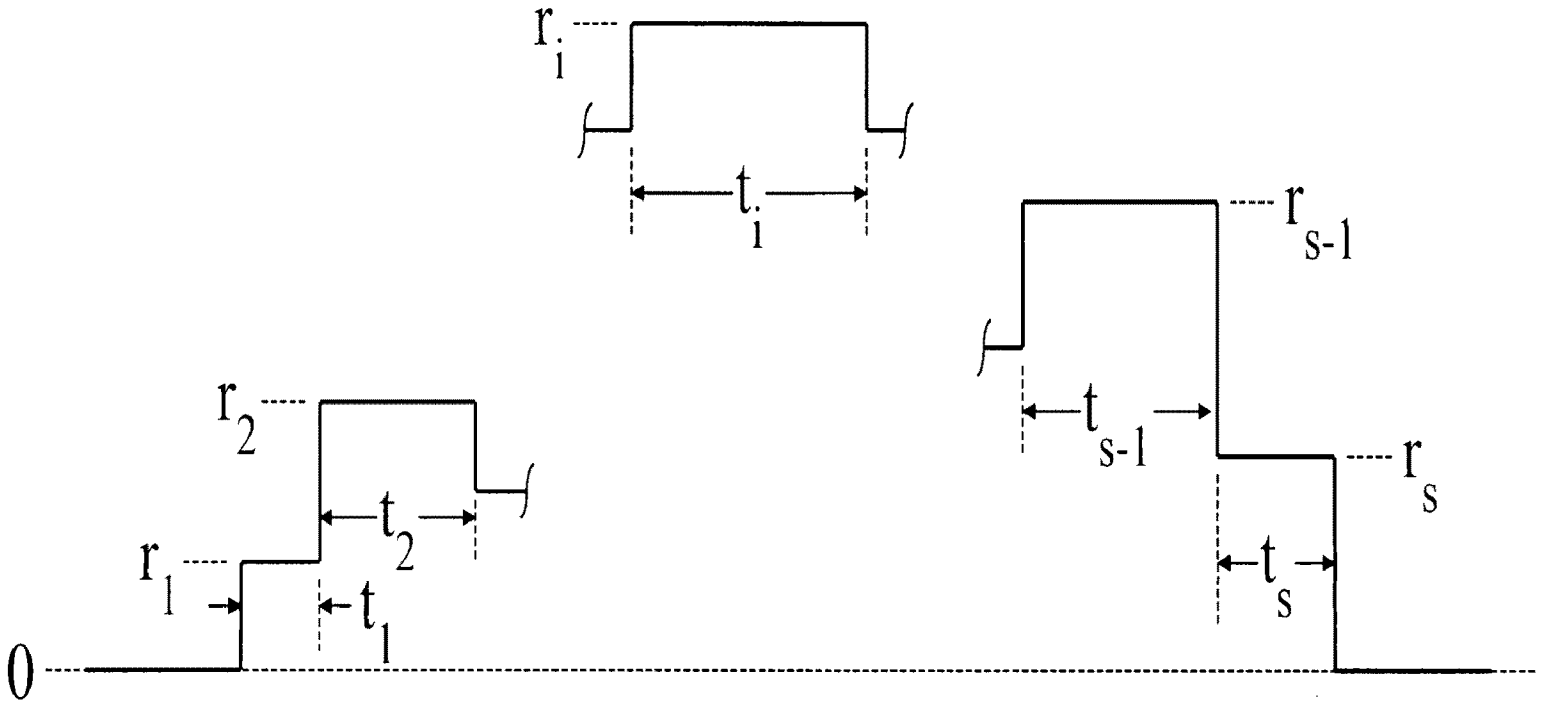
FIG. 3: Shows a set of s-select voltages (pulses) that are used to select each address line of a matrix display.

The method is based on selecting one of the N address lines (rows) in a matrix display at a given instant of time with one of the voltages from a set of 's' voltages $\{+r_1, +r_2, +r_3, \ldots, +r_s\}$ of different amplitudes as shown in FIG. 3. Let the set of data voltages that are applied to the columns be $\{\pm d_1, \pm d_2, \pm d_3, \ldots, \pm d_s\}$. Each row is selected with the s-select voltages sequentially one after the other by applying each voltage ($r_i$) for a certain duration of time ($t_i$). The data voltage that is applied to the column can be any one of the '2·s' data voltages and the sign of data voltages may be opposite or same as that of the select voltage. The voltage across the pixel during the time interval $t_i$ is the difference of the two voltages i.e. $(r_i-(\pm d_{k,i}))$ wherein the index 'i' corresponds to the time interval $t_i$ and 'k' corresponds to the amplitude of the data voltage. Energy delivered to the pixel during the time interval '$t_i$' is: $t_i\cdot(r_i\pm d_{k,i})^2$.

Thus the energy delivered to the pixels can be controlled with:

a) Amplitude of the select and data voltages b) Sign of the select and data voltages c) Duration of the select and data voltages.

Energy delivered to a pixel is small when the sign of the data voltage is same as the select voltage as compared to the case when the sign of data voltage is opposite to that of select voltage. For a specific select voltage say $r_1$ that is applied to a row during $t_1$, data voltages can be any one of 2·s values i.e. $\{+d_1 \text{ or}, -d_1 \text{ or } +d_2 \text{ or}, -d_2 \text{ or } +d_3 \text{ or}, -d_3 \text{ or} \ldots +d_s \text{ or}, -d_s\}$. Hence the energy delivered during the first time interval can be any one of the 2·s values depending on the choice of the data voltage from the set of 2·s values and optionally it can be tuned to a desired value by varying $t_1$. Let the select voltage during the second time interval (i.e. $t_2$) be $r_2$. Choice of data voltages is restricted to one of 2(s−1) in the second time interval because a data voltage of specific amplitude is used just once during the s-time intervals. Hence the energy delivered to a pixel during the second time interval can be one of the 2(s−1) values. Duration of the select and data voltages can also be varied to control the energy delivered to the pixels. The number of data voltages that can be applied to the pixels diminishes as one progress from the first to the final select pulse and it is just two voltages for a specific pixel in the $s^{th}$ (last) time interval. Energy delivered to the pixels can be computed by substituting values of select and data voltages that are applied to the pixels during the s-time intervals) as shown in the following expression.

$$\sum_{i=1}^{s} t_i \cdot (r_i \mp d_{k,i})^2 + (N-1) \cdot \sum_{i=1}^{s} t_i \cdot d_{k,i}^2$$

The first term corresponds to the energy delivered during the select time and the second term corresponds to the energy delivered to the pixel when (N−1) rows (excluding the one in which the pixel is located) are selected. The root-mean-squared (RMS) voltage across the pixel is given by the following expression.

$$V_{\text{RMS}} = \sqrt{\frac{\sum_{i=1}^{s} t_i r_i^2 \mp 2\sum_{i=1}^{s} t_i \cdot r_i \cdot d_{k,i} + N \cdot \sum_{i=1}^{s} t_i \cdot d_{k,i}^2}{N \cdot \sum_{i=1}^{s} t_i}}$$

The first and last terms are constant value for specific sets of select and data voltages because each select and data voltage of specific amplitude is used just once during the s-select intervals. RMS voltage will be one of the s !$2^s$ values depending on the choice of data voltages during the s-time intervals. It is more by a factor s ! as compared to the $2^s$RMS voltages that is achievable by using successive approximation technique. It is the maximum number of unique voltages that can be achieved with the technique of this invention. The actual number of RMS voltages may be lower under certain conditions. Number of unique RMS voltages will reduce by a large factor when the condition for the maximum selection ratio viz., $r_i = \sqrt{N} \cdot d_i$ for all values of i; i.e., i =1,2,3, . . . ,s is imposed. Number of unique combinations will decrease if certain product terms i.e. $r_i \cdot d_{k,i}$ has the same value for more than one $^i$ and $^k$. However, the maximum number of unique RMS voltages is larger than that of successive approximation or any other technique known so far for displaying gray shades in RMS responding displays for a specific matrix display and specific number of voltages and specific number of time intervals. Number of gray shades that can be achieved without any compromise on the selection ratio is shown in Table I. The maximum selection ratio of $$\sqrt{\frac{\sqrt{N}+1}{\sqrt{N}-1}}$$

is achieved with the technique and even then the number of gray shades in higher than that of successive approximation technique as shown in the right most column of Table 1.

TABLE 1

Comparison of the number of gray shades of the present invention with that of successive approximation technique.

| Number of time intervals | Number of gray shades with successive approximation | Maximum number of gray shades with arbitrary sequence (Present Invention) | Maximum number of gray shades with maximum selection ratio (Present Invention) |
|---|---|---|---|
| 2 | 4 | 8 | 7 |
| 3 | 8 | 48 | 34 |
| 4 | 16 | 384 | 225 |
| 5 | 32 | 3840 | 1946 |

Figure 4:
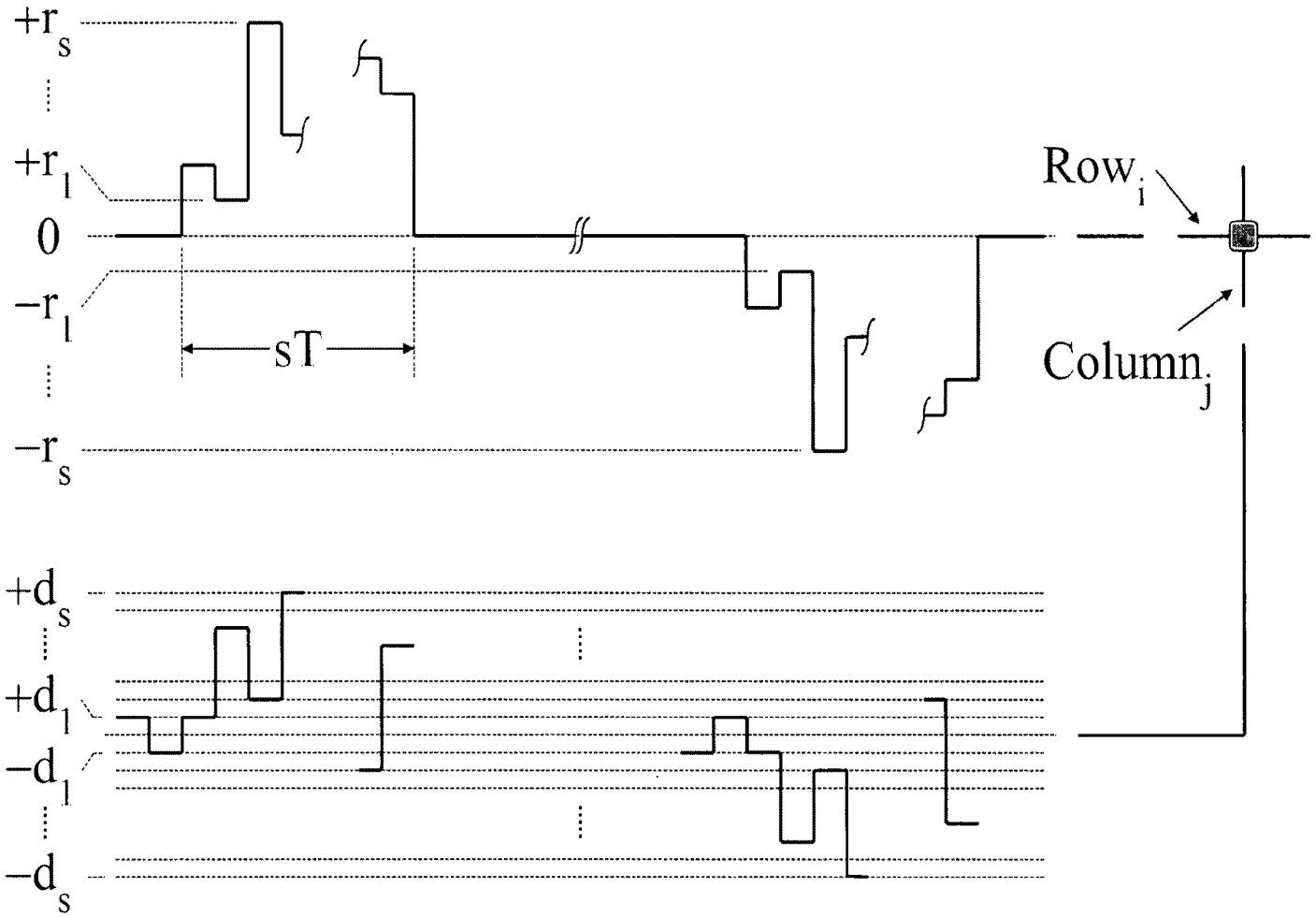
FIG. 4: Shows a typical row waveform (top) and column waveform (bottom) of the method that is disclosed in this invention for displaying gray shades with discrete select sequence (DSS). It is a line-by-line addressing technique wherein voltages corresponding to a discrete sequence of length 's' is used to select the rows and data voltages for each gray shade correspond to one of the many discrete sequence of length 's'. Polarity of the select pulses is reversed periodically to achieve a dc-free operation. A large number of RMS voltages can be generated across pixels even with sequences as short sequence of length 4. RMS voltage is independent of the order in which select voltages are used to select rows in a matrix display.
Figure 5:
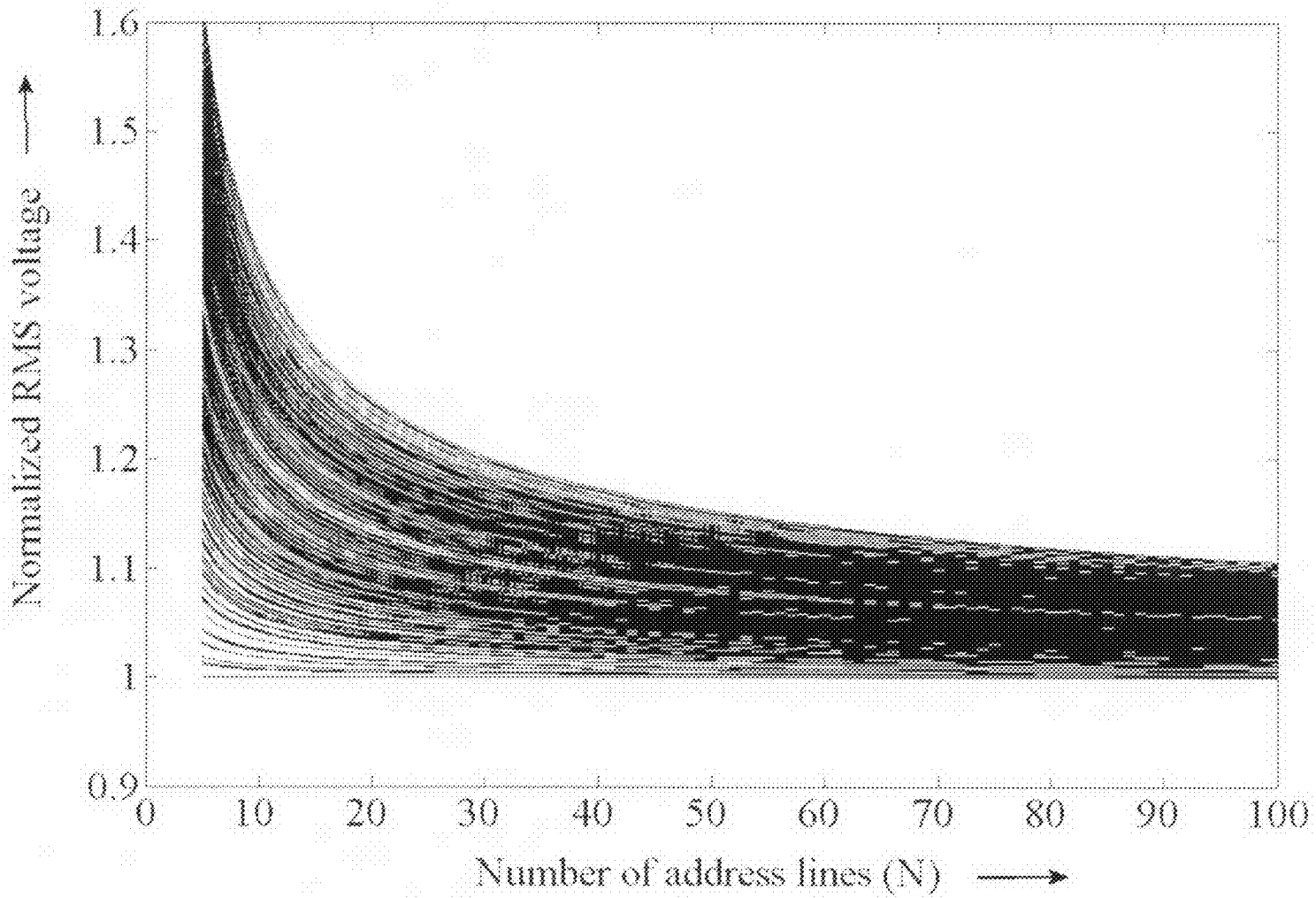
FIG. 5: Shows plot of computer simulation of the method that is disclosed in this invention with 225 unique RMS voltages (normalized to threshold of the liquid crystal display) that can be generated using 9 voltages (to achieve a dc free operation) in the row waveforms and 8 voltages in the data waveforms to display at least 128 gray shades even after correcting for non linearity of the electro-optic response as well as the human eye response by using just 4N time intervals. Row drivers that are capable of applying one of two voltages and column drivers that are capable of applying one of eight voltages are adequate to generate any of 225 RMS voltages across pixels in a matrix display.
Figure 6:
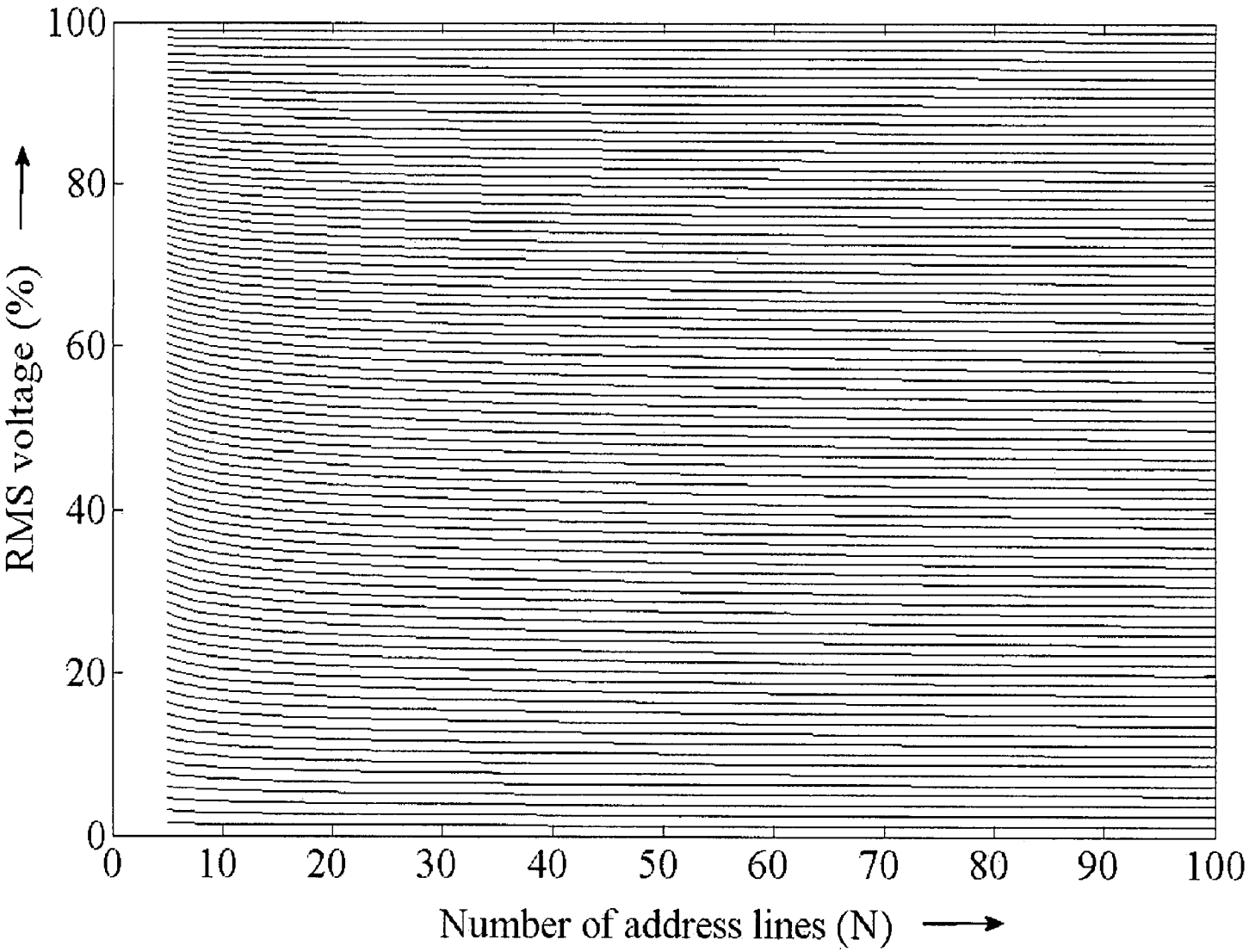
FIG. 6: Shows the computer simulation of the method that is disclosed in this invention: Plot of RMS voltage in percentage that is normalized to the difference of RMS voltages of ON and OFF pixels. The difference of any two adjacent plots is almost equal when 85 unique RMS voltages are generated using 4N time intervals.
Figure 7:
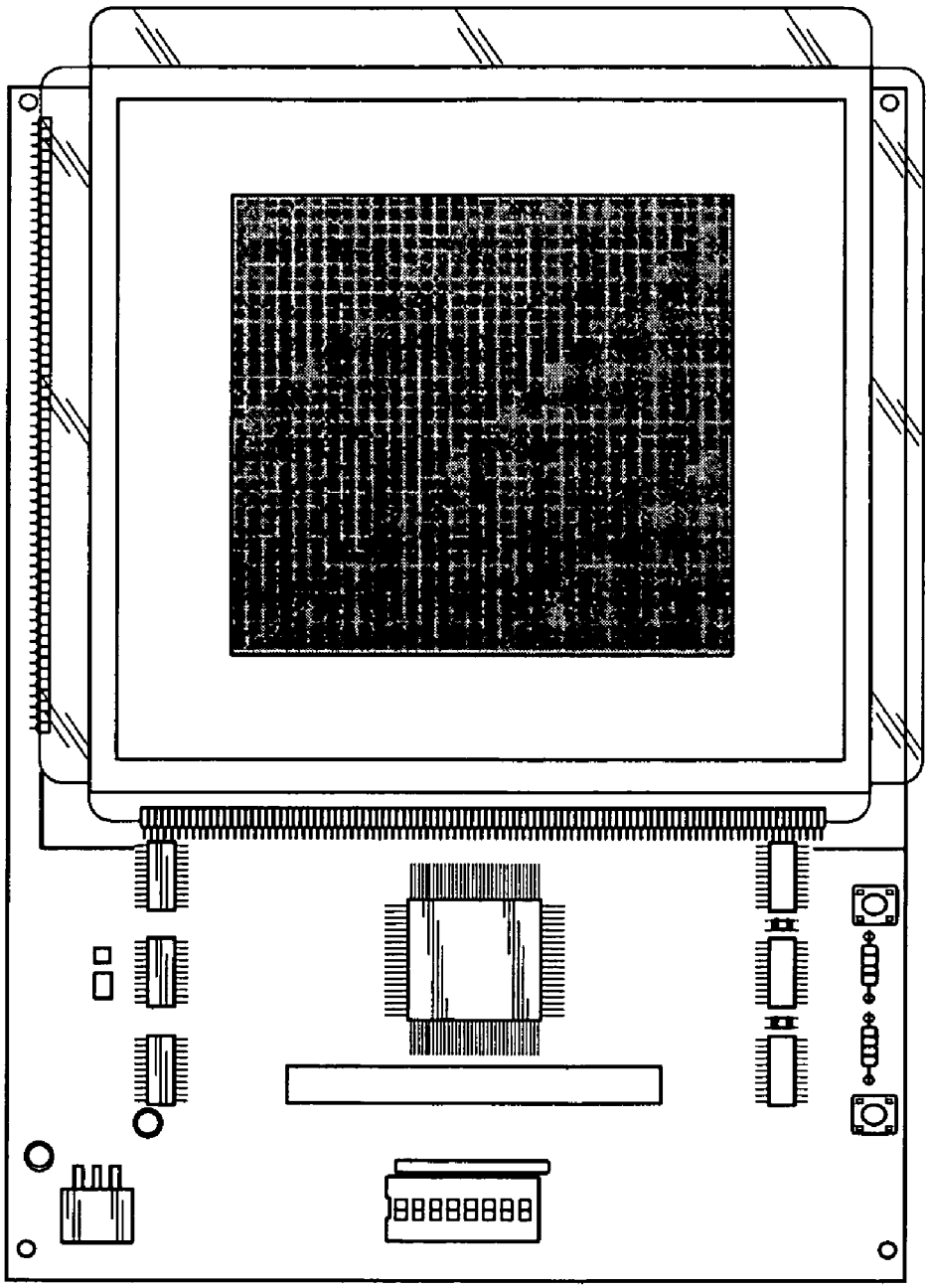
FIG. 7: Shows a photograph of the prototype that demonstrates one embodiment of the instant invention. It is capable of displaying 64 gray shades using row drivers that are can apply any one of two voltages and column drivers that are capable of applying any on of 8 voltages during 4N-time intervals in a cycle.
Figure 8:
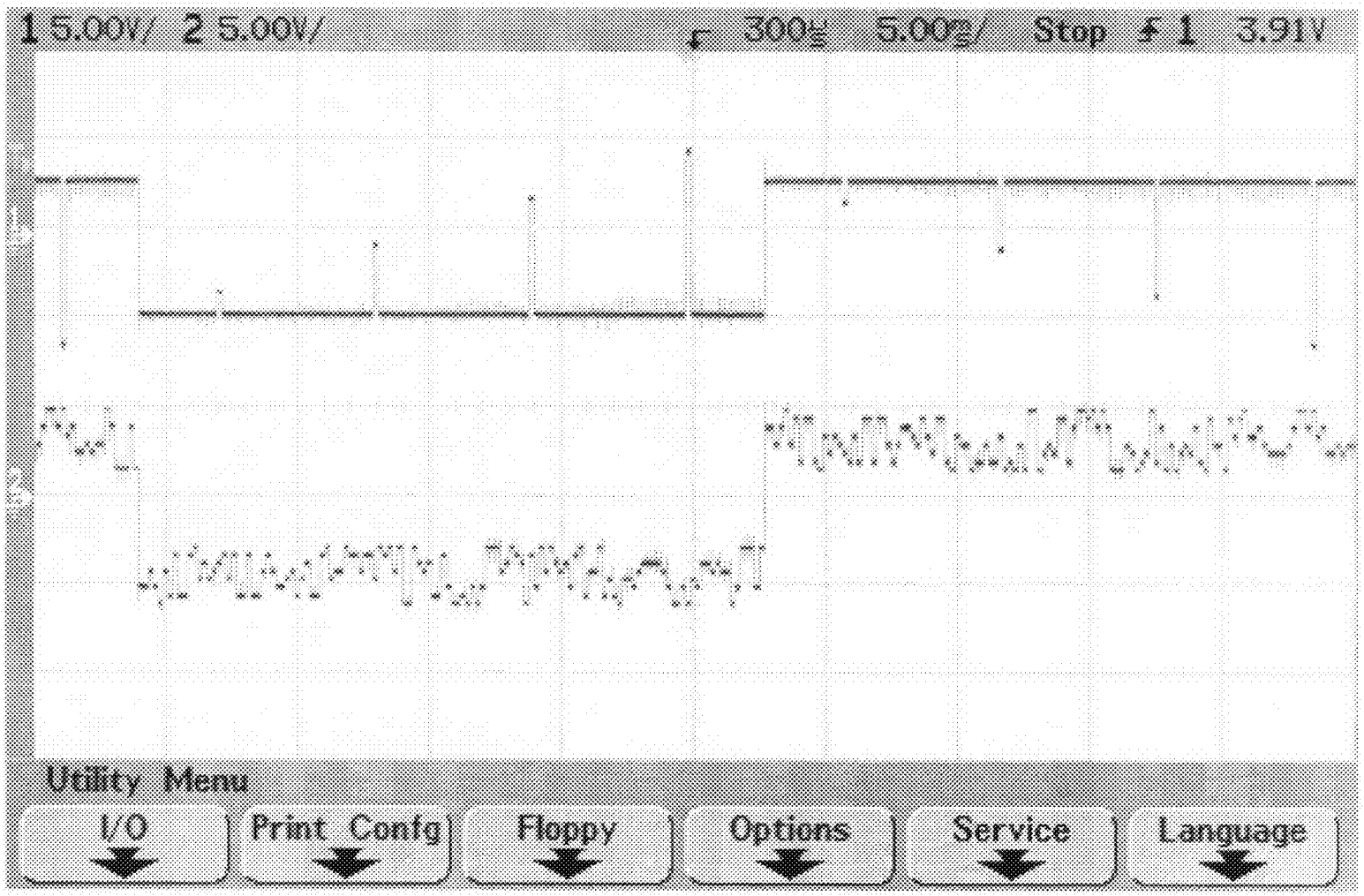
FIG. 8: Shows a typical row (select) waveform (top), column (data) waveform (middle) and the waveform across a pixel (bottom) when the 4-select pulses are distributed in a cycle; when the matrix display is scanned using a discrete select sequence of length 4.
Figure 9:
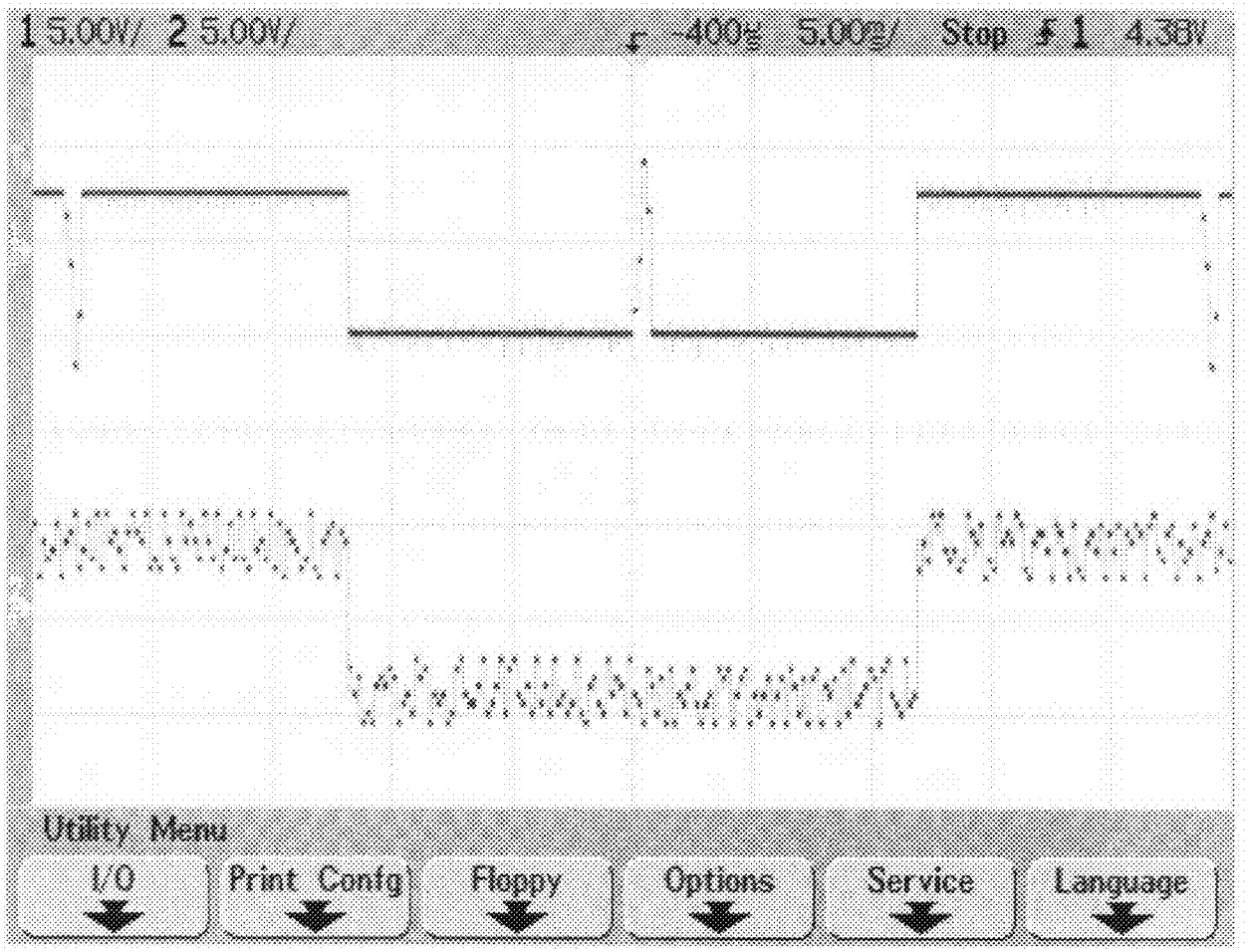
FIG. 9: Shows a typical row (select) waveform (top), column (data) waveform (middle) and the waveform across a pixel (bottom) when the 4 select pulses are clustered in a cycle; when the matrix display is scanned using a discrete select sequence of length 4.

Although, the number of RMS voltages that is achievable during the s time intervals will be less than the maximum ($2^s$s!); it is much higher than the successive approximation technique depending on the values assigned to the select and data voltages. Typical row and column waveforms of one embodiment of the present invention are shown in FIG. 4. Here, the duration of the s-select pulses are equal. Although 384 gray shades are possible with s=4; a maximum of 225 unique RMS voltages (gray shades) is achieved when the condition of maximum selection ratio is imposed. FIG. 5 shows the plot of RMS voltages that is nonmalized to threshold voltage for s=4 and the plots merge and appear as a dark band because the number of gray shades is large (225). The number of time intervals is small (4N-time intervals) as compared to 8N and 224N time intervals that may be necessary to display 225 gray shades with successive approximation and pulse width modulation respectively. Difference of any two neighboring RMS values is not the same for all the RMS voltages. It is possible to achieve uniformly spaced RMS voltages by an appropriate choice of the amplitude of select voltages. FIG. 6 shows 85 equally spaced RMS voltages when four select pulses are used while scanning the display. However, it is not essential that the differences between the adjacent RMS voltages have to be equal because the electro-optic response and the human eye response are nonlinear. A subset of voltages (say 64 or 128 of the total 225) can be used to compensate the non-linearity. The number of gray shades is larger than that of successive approximation even when a subset of the RMS voltages is used in practical application. Row waveforms of this technique have three voltages and column waveforms have '2s' voltages. Polarity of the addressing waveforms is reversed periodically to achieve a dc free operation that is essential for a long life of the display. The technique can achieve 1946 unique RMS voltages when the number of select pulses is 5. A reduction in supply voltage of the drive electronics can be achieved by modifying addressing waveforms by a method similar to that of line-by-line addressing based on wavelets [12] which is based on the method proposed by Kawakami et al for line-by-line addressing technique [13] for displaying binary images. A photograph of the prototype where in the present invention is reduced to practice is shown in FIG. 7. Typical addressing waveforms wherein voltages have been level shifted to reduce the power supply voltage of the drive circuit are shown in FIGS. 8 and 9. Although the number of voltages in the scanning (row) waveforms is (2s+1) at a given instant of time just two voltages viz. a select and the non-select voltages are applied to the display. Hence it is adequate to row drivers that are capable of applying any one of the two voltages while a 2s:1 analog multiplexer that is external and common to all stages of the row driver can be used to choose one of the select voltages depending on the select sequence and the polarity of the select voltage. A data (column) driver that is capable of applying one of 2s voltages is adequate for displaying $({}_{2}s \cdot s!)$ gray shades. In summary the hardware complexity of the driver circuit is low considering the large number of gray shades that can be displayed with good brightness uniformity of pixels.

What is claimed is:

1. A method to display gray shades using a root mean squared (RMS) responding matrix display comprising acts of:

(a) selecting a select voltage ($r_i$) from a first predefined set of s number of select voltages, wherein s is an integer greater than 2;

(b) during a predetermined time interval ($t_i$), selecting a row of the matrix display by applying the select voltage ($r_i$) to the row while all other rows of the matrix display are grounded;

(c) selecting a data voltage ($d_i$) from a second predefined set of 2s number of data voltages during the predetermined time interval ($t_i$), the 2s number of data voltages consisting of a positive and a negative value of each of s number of predetermined voltage amplitudes;

(d) applying the data voltage ($d_i$) to all of the columns of the matrix display simultaneously during the time interval ($t_i$); and (e) repeating (a) - (d) during s−1 number of future time intervals including selecting and applying a different one of the s select voltages and a different one of the s predetermined voltage amplitudes during each of the s−1 future time intervals such that each of the s select voltages and the s predetermined voltage amplitudes is selected and applied only once over a period defined by the predetermined time interval ($t_i$) and the s−1 future time intervals, in order to display gray shades.

2. The method as claimed in claim 1, wherein the polarity of the select and the data voltages are changed periodically to achieve dc-free operation.

3. The method as claimed in claim 1, wherein a magnitude of one of the s select voltages is equal to a product of a magnitude of one of the s predetermined voltage amplitudes and a square root of the number of rows in the matrix display.

4. The method as claimed in claim 1 or 3, wherein the s predetermined voltage amplitudes are chosen to obtain uniformly spaced RMS voltages.

5. The method as claimed in claim 4 wherein subsets of the RMS voltages are used to correct non-linearity of electro-optic response and/or human eye response.

6. The method as claimed in claim 1 or 3, wherein the s predetermined voltage amplitudes are chosen to obtain a maximum number of RMS voltages.

7. The method as claimed in claim 1 or 3, wherein the select voltages are alternatively arranged in an ascending order and descending order to reduce power dissipation in driver circuit.

8. The method as claimed in claim 1 or 3, wherein a duration of at least one of the predetermined time interval ($t_i$) and the s−1 future time intervals is different than a duration of another one of the predetermined time interval ($t_i$) and the s−1 future time intervals.

9. The method as claimed in claim 8, wherein the length of the predetermined time interval ($t_i$) determines amount of energy delivered to each pixel of the matrix display.

10. The method as claimed in claim 1 or 3, wherein at least one of polarity, amplitude, and application duration of the select and the data voltages is varied to correspondingly vary RMS voltage across each pixel of the matrix display.

11. The method as claimed in claim 1, wherein the number of gray shades is greater than that of successive approximation technique.

12. The method as claimed in claim 1, wherein the method provides for more number of gray shades than available with successive approximation technique with maximum selection ratio.

13. The method as claimed in claim 1, wherein a magnitude of one of the s select voltages is proportional to one of the s predetermined voltage amplitudes.

14. The method as claimed in claim 1, wherein the matrix display is passive matrix liquid crystal display (LCD) that is one of a twisted nematic LCD, a super twisted nematic LCD, a ferro-electric LCD, and an anti-ferro-electric LCD.

15. The method as claimed in claim 1, wherein the order of selection and application of the s select voltages is random.

* * * * *